US006397756B1

(12) United States Patent
Saiko et al.

(10) Patent No.: US 6,397,756 B1
(45) Date of Patent: Jun. 4, 2002

(54) AMUSEMENT DEVICE

(76) Inventors: Alfons Saiko, Speerstrasse 26a, 8942, Oberrieden (CH); Reinhold Spieldiener, Im Gafos 25, 9494, Schaan (LI); Robert Spieldiener, Joseph-Rheinberger-Strasse 18, 9490, Vaduz (LI); Patrick Spieldiener, Bildgasse 42, 9494, Schaan (LI)

( * ) Notice: Subject to any disclaimer, the term of this patent is extended or adjusted under 35 U.S.C. 154(b) by 0 days.

(21) Appl. No.: 09/857,910

(22) PCT Filed: Dec. 17, 1999

(86) PCT No.: PCT/EP99/10042

§ 371 (c)(1),
(2), (4) Date: Jun. 11, 2001

(87) PCT Pub. No.: WO00/37155

PCT Pub. Date: Jun. 29, 2000

(30) Foreign Application Priority Data

Dec. 22, 1998 (DE) ..... 298 22 644 U

(51) Int. Cl.[7] ..... A63G 21/00

(52) U.S. Cl. ..... 104/53; 104/63; 104/172.1; 104/173.1

(58) Field of Search ..... 104/53, 55, 63, 104/172.1, 173.1

(56) References Cited

U.S. PATENT DOCUMENTS

| | | | | | |
|---|---|---|---|---|---|
| 1,040,125 | A | * | 10/1912 | Bickford | 104/55 |
| 1,084,390 | A | | 1/1914 | Bosworth | |
| 2,642,005 | A | * | 6/1953 | Cooper | 104/63 |
| 4,165,695 | A | * | 8/1979 | Schwarzkopf | 104/55 |
| 4,270,459 | A | * | 6/1981 | Schwarzkopf | 104/63 |

FOREIGN PATENT DOCUMENTS

| | | |
|---|---|---|
| DE | 104 899 | 8/1898 |
| DE | 28 32 991 | 2/1980 |
| FR | 2 721 888 | 1/1996 |
| WO | WO 98/45007 | 10/1998 |

* cited by examiner

*Primary Examiner*—Joseph Morano
*Assistant Examiner*—Lars A. Olson
(74) *Attorney, Agent, or Firm*—McGlew and Tuttle, P.C.

(57) ABSTRACT

To move a rail-borne vehicle (2) over a preferably ascending partial section, a finite chain section (8) is pulled in a stationary guide (13) in parallel to the rail (23) using a cable (9). The vehicle (2) engages the chain section (8) via a chain hook (19). The two ends (35), (36) of the cable (9) are connected to the leading end (34) of the chain section (8). The vehicles (2) can be moved rapidly with this cost-saving arrangement. It is also possible to overcome steeper uphill sections than in the state of the art (pull-up devices of roller-coasters).

17 Claims, 2 Drawing Sheets

AMUSEMENT DEVICE

FIELD OF THE INVENTION

The present invention pertains to a conveying device for rail-borne vehicles or trains of vehicles for overcoming the ascent on a peak and valley section, especially for amusement facilities, in which a towing aid guided along the rails in a guide is brought detachably into engagement with the vehicle via a chain hook or the like.

BACKGROUND OF THE INVENTION

Such conveying sections occur as pull-up aid for the vehicles, e.g., in amusement facilities, especially in roller-coasters, mountain and valley railways. The vehicles are brought to the highest point of the amusement facility by means of a motor in order to travel through the section by themselves with momentum. Endless chain drives guided along the rails, which extend along the uphill section between the rails, are used for moving up the vehicles by means of the motor (DE-OS 28 32 991). The individual vehicle is towed by means of a chain hook by the circulating chains up to the highest point of the amusement facility to be separated from the pull-up chain there. Such a circulating conveying chain has a considerable weight, especially in the case of great differences in height, and requires continuous maintenance because of the great wear. Because of the polygonal effect at its deflecting wheels, the velocity of conveying of the prior-art pull-up aid is limited. In addition, considerable noise is generated at the deflecting and drive wheels.

If the goal is to substantially increase the height difference and the steepness of the pull-up section, the prior-art pull-up aid is not advantageous either commercially or technically.

SUMMARY AND OBJECTS OF THE INVENTION

The basic object of the present invention is to develop a conveying aid which is suitable for overcoming great differences in height, does not require a circulating conveying chain, results in lower costs, and permits a higher velocity of conveying with reduced environmental pollution and reduced lubricant usage.

The object of the present invention is accomplished by the towing aid comprising a finite section, especially a chain section, which is connected with its front end to the uphill section of an endlessly guided cable and is pulled by same upwards along the ascent of the uphill section up to over the apex of the uphill section and is subsequently moved downward. The section comes to lie with the rear end under the waiting vehicle in its starting and inoperative position and is located with its front end in the foot area of the ascent of the uphill section above the lower deflecting roller of the cable.

This measure has the advantage that the finite section is pushed under the waiting vehicle during its rearward movement and can be connected to it there via the chain hook while the front end of the section is already located in the foot area of the ascent. As a result, the cable does not get into the concave transition area at the lower end of the ascent of the uphill section.

The subject of the present invention can be used with great advantage in all kinds of amusement facilities instead of the prior-art pull-up aids. The present invention permits greater differences in height and steeper angles of ascent as well as higher velocities of conveying.

However, conveying devices according to the present invention may also be used in other technical areas, e.g., in industrial materials handling technology where it is important to accelerate rail-borne vehicles from a standstill at certain points or the move them over ascents.

Even though an amusement facility in which a vehicle is moved to and fro by a swaying movement along a U-shaped section open in the upward direction has been known from U.S. Pat. No. 1,084,390, a carrier, which carries the vehicle to the highest point of the leg and lets it go for the downward travel there by releasing, is fastened to a concave section of an endless cable, which said section slides along a leg. The cable rubs along on the metal profile of the leg and therefore requires the use of a considerable amount of lubricant.

Contrary to this, concave guiding of the cable is completely avoided in the present invention in the area of the uphill section, so that the cable can be guided either linearly or convexly via guide rollers and it can therefore be kept free from vibrations.

Numerous embodiments of the present invention are disclosed in the subclaims.

The cable is advantageously connected with both of its ends to the front end of the chain section. The chain section is thus pulled during upward movement and pushed during reverse movement.

In one exemplary embodiment, the individual section comprises only a few chain links, which are guided by means of guide rollers in a guide of their own, which extends along the rails. According to the present invention, the chain section and the cable form a driven conveying section guided via a cable drive unit, e.g., a winch or an adhesive drive.

However, other towing aids, e.g., rods with guide rollers or the like, may also be used instead of chain links.

In another exemplary embodiment of the present invention, a deflecting roller for the cable is located at the foot of the ascent of the uphill section such that the cable ascends linearly from the circumference of the deflecting roller via the leading end of the section. The cable can thus be guided easily because it is exposed only to convex curvatures above the deflecting roller and is not exposed to any concave curvatures.

The section needs to be only long enough to make it possible to push its rear end under the vehicle, which is in the horizontal position. To move the vehicle upward on an uphill section, the vehicle only needs to be brought into connection with the section via a chain hook, which is known per se, after which the cable will move the section upward until the vehicle being carried moves past the apex of the uphill section and can be moved forward from there. by its own momentum. As soon as the vehicle is separated from the section, this section is again pushed back into its starting position by the reversal of the cable drive to pick up the next vehicle there.

It is apparent from this that such relatively short sections may be arranged at any point of the track section, e.g., even on flat sections.

It proved to be advantageous for the individual chain link of the section to have the same length as the axle base of the running wheels of the vehicle. It is thus possible to always guide the individual chain link in parallel to and at an equal distance from the vehicle, without great curvatures of the track being able to have an effect.

The distance between the cable rollers is substantially smaller in the case of a curved section than on straight curves. The deflection of the cable is reduced and the wear on the cable is thus substantially reduced as a result.

To keep the length of the individual cable as short as possible, provisions are made according to the present invention for the cable to be separated from the guide after an uphill section has been overcome and being returned to the cable drive unit. This may be designed in such a way that the direction of rotation is reversed in order to make possible the forward and reverse movement of the chain section with a single cable. However, it is also possible to use two cables, which are arranged in parallel to one another and can be driven in opposite directions and are associated with a cable drive unit of their own.

Two U-shaped guide profiles may be arranged at spaced locations from one another. These have cavities directed toward one another and are arranged between the rails for receiving the guide rollers connected to the chain links. The individual chain link may comprise two strips forming a distance from one another, wherein the chain hook of the vehicle cooperates with a respective axle of the guide rollers between the strips. The guide of the cable may extend just below the chain links in the area of the distance located between the strips of the chain links.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
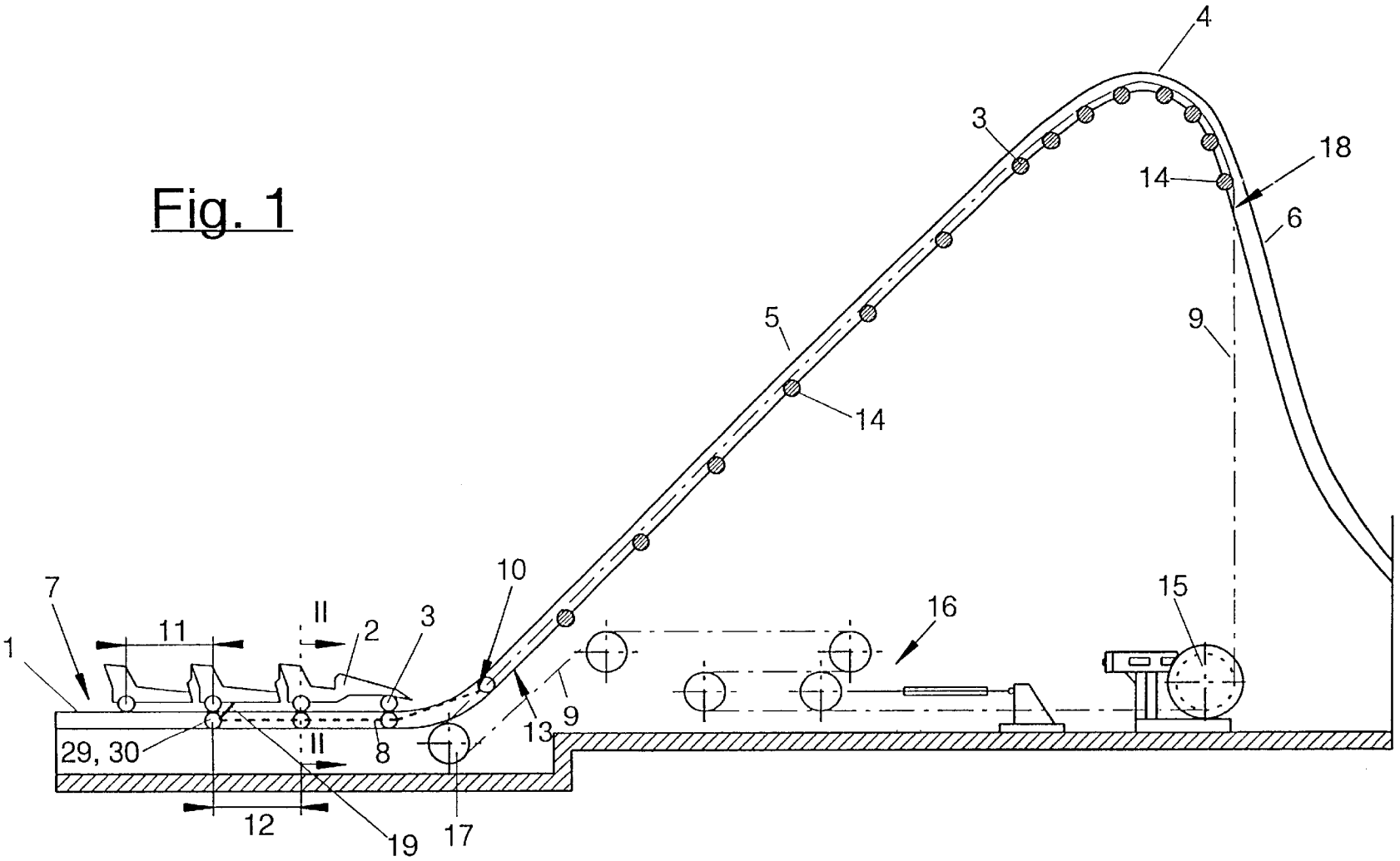
FIG. 1 is a side partially sectional view showing an uphill section of an amusement facility with a finite chain section.

Referring to the drawings in particular, part of a track 1 is shown in a side view in the exemplary embodiment according to FIG. 1. Rail-borne vehicle 2 is guided by means of running wheels 3 on part of a track 1. A flat valley section 7 is joined by an uphill section 5 and a greatly curved, upper track section 4, which passes over into a downhill section 6. The routing is freely selectable.

Figure 2:
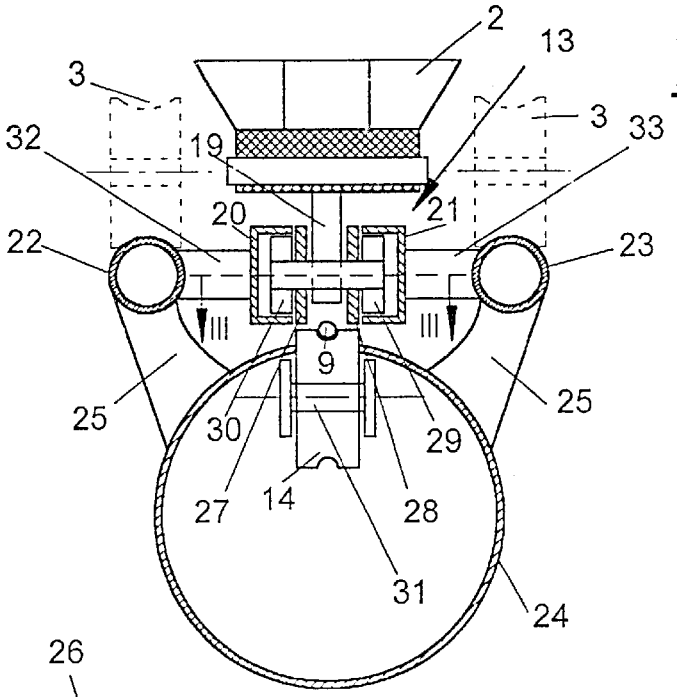
FIG. 2 is a sectional view along line II—II in FIG. 1 (in an enlarged view)

A finite chain section 8 is guided by force in a stationary guide 13 in parallel to the track 1, which is formed by rails 23 (see FIG. 2). The front end 34 of the chain section 8 is connected to the front and rear ends 35, 36 of a cable 9. This cable 9 is led from the foot of the uphill section 5 in parallel to the track 1 up to about the turning point 18 of the downhill section 6 in order to separate from the track 1 there and to lead to a cable drive unit 15. Over deflecting rollers 17 and a clamping means 16, the cable again leads to the leading end 34 of the finite chain section 8. When the drive shaft of the drive unit 15 is driven clockwise, the cable 9 pulls the chain section 8 up the uphill section 5 and, beyond the apex of the curved track section 4, to a point at which the vehicle 2 can separate from the chain section 8. The chain section 8 is moved back from this upper position by the cable drive unit 15 now being driven counterclockwise. The chain section 8 is now pushed back into the starting position by its guide 13, while the front end 36 of the cable 9 is pulled back at the leading end 34 of the chain link 26 (see FIG. 3).

It is also possible to connect two mutually independent cables 9, which can be driven in opposite directions, to the leading end 34 of the chain section 8.

The position of the deflecting roller 17 at the foot of the uphill section 5 is essential. The front end 36 of the cable 8 is guided as a result aligned with the uphill section 5 up to the front end 10 of the chain section 8 and guiding of the cable 9 along a concave curvature is avoided.

The guiding for the individual chain section 8 appears, e.g., from the cross section according to FIG. 2.

In order for the individual chain links 26 of the chain section 8 to be always guided in parallel to the vehicle 1, even in sharply curved sections 4, the chain section 8 is dimensioned such that the length 12 of one chain link 26 is equal to the distance 11 between the axles 3 of the vehicle. As is apparent from FIG. 1, the cable rollers 14 for guiding the cable 9 are spaced farther apart from one another along straight track sections than in the area of curved track sections 4. Even a minimal distance of the cable rollers 14 is recommended in sharply curved track sections 4 in order to keep the wear on the cable as low as possible.

The exemplary embodiment in FIG. 2 shows how a finite chain section 8 can be guided along the track 1. In the usual manner, the track has two rails 22, 23 arranged in parallel to one another, which are connected in the usual manner to a central support pipe 24 extending along the track 1 via braces 25. Crossheads 32, 33 extend from the rails 22, 23 to U-shaped guide profiles 20, 21, whose cavities face one another. Guide rollers 29, 30, which are arranged at the beginning and at the end of an individual chain link 26 each, are movable in these guide profiles 20, 21. The individual chain link 26 comprises two strips 27, 28, which are arranged in parallel to and at spaced locations from one another, between which there is a distance which is needed for the engagement of the chain hook 19. This chain hook 19 cooperates with the axles 37 of the guide rollers 29, 30.

The cable 9 is guided just below the strips 27, 28 in the area of the space between them. It is indicated in the example according to FIG. 2 that cable rollers 14 are mounted rotatably on axles 31 in the support pipe 24. The cable 9 may be guided in another way as well. It is expedient to maintain the parallelity of the cable guiding 9 to the chain link guide 13.

Figure 3:
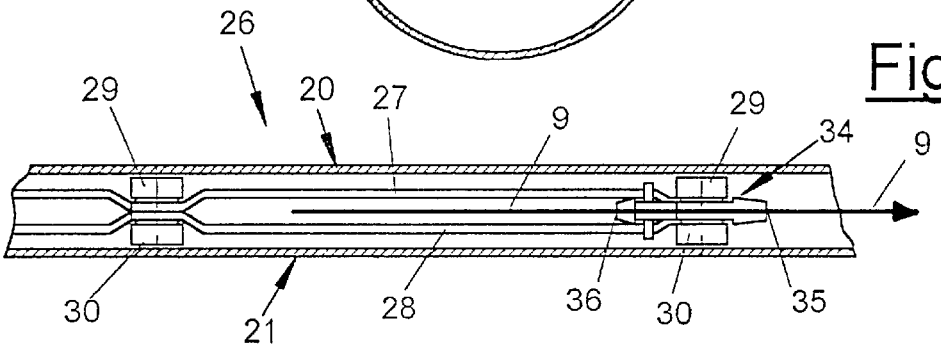
FIG. 3 is a top view of a chain link of a finite chain section.

FIG. 3 shows a top view of an individual chain link 26. In the area of its leading end 34, the respective front chain link 26 has a connection to the rear end 35 as well as to the front end 36 of the cable. If the cable 9 is being moved in the direction of the arrow, upward movement of the finite chain section 8 along the uphill section 5 takes place. If the cable 9 is being moved in the reversed direction, the finite chain section 8 is pushed back into the starting position. The parallel arrangement of the strips 27, 28 of the individual chain links 26 at spaced locations from one another and the guiding of the cable 9 between these strips 27, 28 can also be recognized from FIG. 3.

Figure 4:
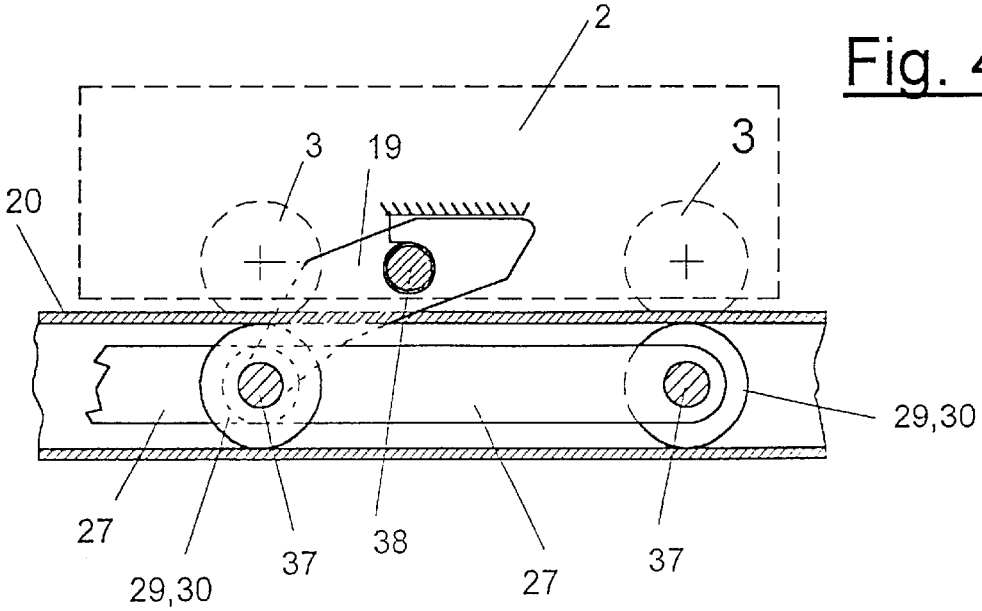
FIG. 4 is a side view of a part of a finite chain section which a chain hook engaging same.

FIG. 4 shows how the individual chain hook 19 of the vehicle 2 acts on the axle 37 of one of the guide rollers 29, 30. The chain hook 19 is guided rotatably around the drag bearing 38 and drops by itself into the axle 37 of the chain link 26 by the force of gravity or under the action of a spring.

As can be recognized from FIG. 1, the chain hook 19 is arranged on the middle vehicle 2 of a trains of vehicles. As a result, the couplings of the vehicles are subject to less load because half of the train of vehicles is pushed and only the other half of the train of vehicles is pulled.

While specific embodiments of the invention have been shown and described in detail to illustrate the application of the principles of the invention, it will be understood that the invention may be embodied otherwise without departing from such principles.

What is claimed is:

1. A rail-borne vehicle conveying device for a rail borne vehicle with a chain hook, the conveying device comprising:

a guide extending along at least a portion of a pair of rails;

an endlessly guided cable with lower deflection roller;

a finite chain section guided along the rails by said guide, said finite chain section having a front end and a rear end, said front end connecting with an uphill section of a said endlessly guided cable for pulling said finite chain section along an ascent of an uphill section up to and over an apex of the uphill section and for subsequently being moved downward to position said finite chain section with said rear end in a starting and inoperative position under a vehicle and with said front end in a foot area of the ascent of the uphill section above said lower deflection roller of said cable.

2. A conveying device in accordance with claim 1, wherein said finite chain section comprises a few chain links guided via guide rollers in said guide.

3. A conveying device in accordance with claim 2, wherein a chain of said few chain links has a length substantially equal to an axle base of running wheels of the vehicle.

4. A conveying device in accordance with claim 3, comprising two said U-shaped guide profiles, which are arranged at spaced locations from one another and whose cavities are directed toward one another, are arranged between said rails for receiving said guide rollers connected to said chain links, and that said individual chain link comprises two strips forming a distance from one another, wherein said chain hook of said vehicle cooperates with a respective axle of said guide rollers between said strips.

5. A conveying device in accordance with claim 2, wherein said guide comprises two U-shaped guide profiles arranged at spaced locations from one another and whose cavities are directed toward one another, said two U-shaped guide profiles being arranged between said rails for receiving said guide rollers connected to said chain links, and wherein each individual chain link comprises two strips forming a distance from one another, wherein the chain hook of said vehicle engages with a respective axle of said guide rollers between said strips.

6. Amusement facility in accordance with claim 5, wherein said finite chain section comprises a few chain links and each of said individual chain links comprises two strips forming a distance from one another guided in said guide and said cable guide extends just below said chain links in an area of the distance located between said strips of said chain links.

7. A conveying device in accordance with claim 1, wherein said finite chain section and said cable form an endless drive guided via a cable drive unit.

8. A conveying device in accordance with claim 7, is wherein said lower deflecting roller for said cable is located at the foot of the ascent of the uphill section such that said cable rises linearly from the circumference of said deflecting roller over said leading end of said section.

9. A conveying device in accordance with claim 8, comprising said cable drive unit is designed as a drive whose direction of rotation is reversible.

10. A conveying device in accordance with claim 7, further comprising a cable drive unit wherein said cable separates from said cable guide at a location beyond the apex of the uphill section and is returned to said cable drive unit.

11. A conveying device in accordance with claim 10, comprising said cable drive unit is designed as a drive whose direction of rotation is reversible.

12. A conveying device in accordance with claim 10, comprising said cable drive unit is designed as a drive whose direction of rotation is reversible.

13. A conveying device in accordance with claim 7, wherein said drive unit is one of a winch or an adhesive drive.

14. A conveying device in accordance with claim 1, further comprising a cable guide formed by cable rollers or sliding elements wherein said cable is guided in parallel to said guide.

15. A conveying device in accordance with claim 14, wherein a distance between said cable rollers is shorter in a curved section than in a straight section of said rails.

16. Amusement facility in accordance with claim 14, herein said cable guide extends just below said chain links in an area of the distance located between said strips of said chain links.

17. A conveying device in accordance with claims 14, comprising said cable separates from said guide behind the apex of said uphill section and is returned to said cable drive unit.

* * * * *